United States Patent [19]

Wang

[11] Patent Number: 4,699,246

[45] Date of Patent: Oct. 13, 1987

[54] MULTIPURPOSE LADDER

[76] Inventor: Yaw C. Wang, No. 81, Lane 304, Sec. 1, Chye Dong Road, Chang Hwa, Taiwan

[21] Appl. No.: 914,500

[22] Filed: Oct. 2, 1986

[30] Foreign Application Priority Data

Oct. 29, 1985 [TW] Taiwan ..... 74209044

[51] Int. Cl.[4] ..... E06C 1/08; E06C 1/383

[52] U.S. Cl. ..... 182/24; 182/27

[58] Field of Search ..... 182/21, 22, 23, 24, 182/27

[56] References Cited

U.S. PATENT DOCUMENTS

| | | | |
|---|---|---|---|
| 316,643 | 3/1885 | Niehaus | 182/24 |
| 781,898 | 2/1905 | McNaughton | 182/24 |
| 1,722,844 | 7/1929 | Faulkenberry | 182/27 |
| 2,012,592 | 8/1935 | Skiba | 182/27 |
| 3,143,185 | 8/1964 | Wenger | 182/24 |
| 3,208,553 | 9/1965 | Gray | 182/24 |
| 3,474,881 | 10/1969 | Green | 182/24 |
| 3,554,318 | 1/1971 | Knight | 182/27 |

FOREIGN PATENT DOCUMENTS

| | | | |
|---|---|---|---|
| 1106616 | 7/1955 | France | 182/27 |

*Primary Examiner*—Reinaldo P. Machado

*Attorney, Agent, or Firm*—Birch, Stewart, Kolasch & Birch

[57] ABSTRACT

The present invention discloses a multipurpose ladder, and comprises four section-ladders; four pivot joint device provided between section-ladders, respectively, for connection but at least one pivot joint device being separable. Said pivot joint devices are available for bending or folding. So that, the multipurpose ladder can be change into a climbing ladder, horse ladder, frame ladder and right-angled ladder.

3 Claims, 8 Drawing Figures

MULTIPURPOSE LADDER

BACKGROUND OF THE INVENTION

1. Field of the Invention

The present invention relates to a multipurpose ladder and more particularly to the ladder with variform types depending on practical needs.

2. Description of Background Art

A ladder is often seen in a working place for climbing high and having high practical value. According to its form for classification, there are four types of ladders, that is, a climbing ladder, horse ladder, frame ladder and right-angled ladder, The climbing ladder. as shown in FIG. 1, includes a straight ladder (11) with predetermined length for leaning upon walls so that a user can climb on it for work. The horse ladder, as shown in FIG. 2, consists of two straight ladders (12) (13) being pivoted jointly at their top ends that they may be erected on the ground with the desired angle. The frame ladder, as shown in FIG. 3, provides a cross ladder (16) which is pivoted jointly between two spaced apart straight ladders (12) (13) to form an upside-down "U" type, so that, a may work on it for suspending operation. The right-angled ladder, as shown in FIG. 4, includes an oblique ladder (17) being pivoted on a straight ladder (18) which contacts the ground with a 90° right-angle. Furthermore, the right-angled ladder is designed with wider transverse step boards so as to enable a user carrying heavy things to climb up without holding the ladder with his or her hands.

Viewing various types of ladders describing above, each has its own unique function. On the other hand, the application of different types of ladders depends on the nature of work and the work place. Hence, different ladders are designed for various purposes, therefore, purchasing separately will increase the cost and occupy stock space, so that, to invent a multipurpose ladder is the greatest urgency at present for the market.

SUMMARY OF THE INVENTION

The primary object of the present invention is to provide a multipurpose ladder which can be varied to a climbing ladder, horse ladder, frame ladder and right-angled ladder according to desirability and thus has multipurpose.

In accordance with the present invention, a multipurpose ladder comprises four section-ladders with different lengths, a plurality of pivot joint devices provided between each section-ladder respectively for connection and at least one pivot joint device being separable, in which:

disengaging one pivot joint device to make the four section-ladders in form of a straight line to be a climbing ladder;

applying the shortest section-ladder as a bottom and making the other three section-ladders forming an isosceles triangle to form a horse ladder;

taking the longest section-ladder as bottom and keeping the longer section-ladder in parallel with the longest section-ladder by the other two section-ladders' supporting at both sides respectively to form a frame ladder in form of a trapezoid;

employing the longer section-ladder and the shortest section-ladder as bottom, taking the shorter section-ladder perpendicular to bottom the while keeping the longest section-ladder oblique to form a right-angled ladder.

BRIEF DESCRIPTION OF THE DRAWINGS

The present invention will be more fully understood from the following detailed description, taken in connection with the accompanying drawings which form an integral part of this application and in which.

DETAILED DESCRIPTION OF THE PREFERRED EMBODIMENT

Figure 1:
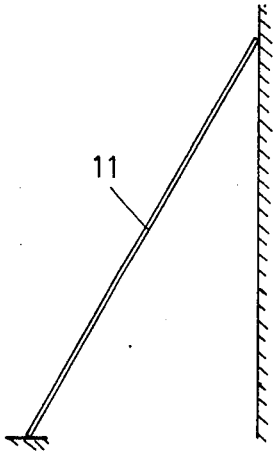
FIG. 1 is a view of a conventional climbing ladder.
Figure 2:
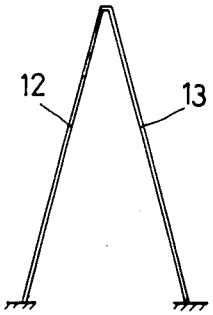
FIG. 2 is a view of a conventional horse ladder.
Figure 3:
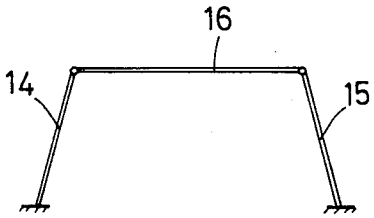
FIG. 3 is a view of a conventional frame ladder.
Figure 4:
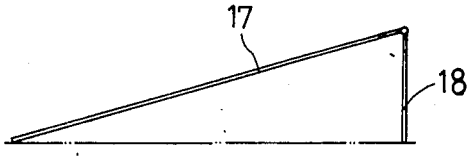
FIG. 4 is a view of a conventional right-angled ladder.
Figure 5:
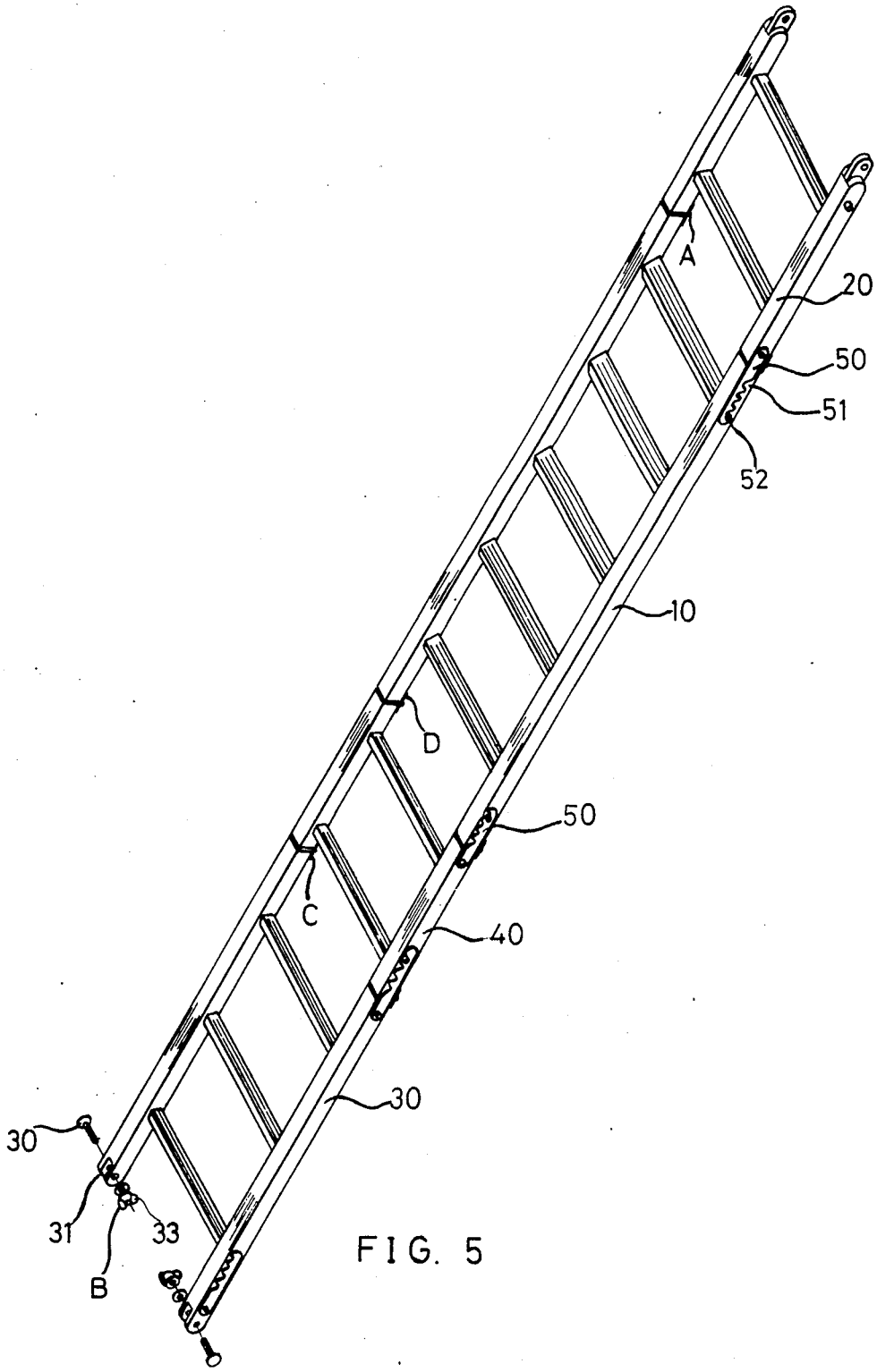
FIG. 5 is a perspective view of a multipurpose ladder in the form of a climbing ladder in accordance with one preferred embodiment of the present invention.

Referring now to the drawings, it should be noted that a like member is designated with a like reference number. With reference to FIG. 5, a multipurpose ladder comprises four section-ladders with different lengths (10) (20) (30) (40), in which, the 1st section (10) is the longest section-ladder, the 3rd section (30) is the longer section-ladder, the 2nd section (20) is the shorter ladder and the 4th section (40) is the shortest section-ladder. That is, the length of the 1st section (10)>the 3rd section (30)>the 2nd section (20)>the 4th section (40), and the length of the 1st section (10) equal to the length of the 2nd section (20) plus the length of the 3rd section (30). Further, the multipurpose ladder provides four pivot joint devices, namely A, B, C, and D between said four section-ladders respectively for connecting with each other. These pivot joint devices are articulated and available for bending and folding within 180 degree, in which, the pivot joint device B is separable. A gap trough (31) is located at the bottom of the 3rd section-ladder (30) while a nose (21) is located at the top end of the 2nd section-ladder for inserting into said gap trough (31) and fixed by a bolt (32) and a butterfly nut (33). Both sides of each section-ladder are provided with a retaining plate (50) one of its ends is pivoted to a section-ladder and its other end provides a retaining hole (51) for the engagement of bar (52) with the other section-ladder, in order to fix and set these section-ladders to prevent revolving. Herein, one point deserving for emphasis is that the location of retaining hole (51) has been predetermined to suit different forms of the multipurpose ladder.

Figure 6:
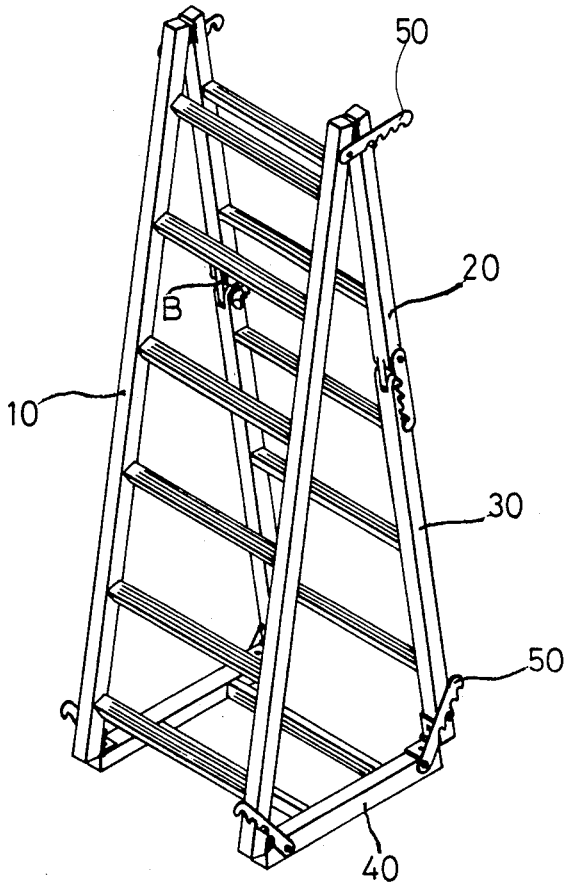
FIG. 6 is a perspective view of a multipurpose ladder in the form of a horse ladder in accordance with one preferred embodiment of the present invention.

As illustrated in FIG. 6, connecting the pivot joint device B and employing the 4th section-ladder (40) as a bottom while taking the 1st section-ladder (10), 2nd section-ladder and 3rd section-ladder to form an isosceles triangle, the ladder becomes a horse ladder. Moreover, retaining plates are provided between section-ladders to prevent them from deviation.

Figure 7:
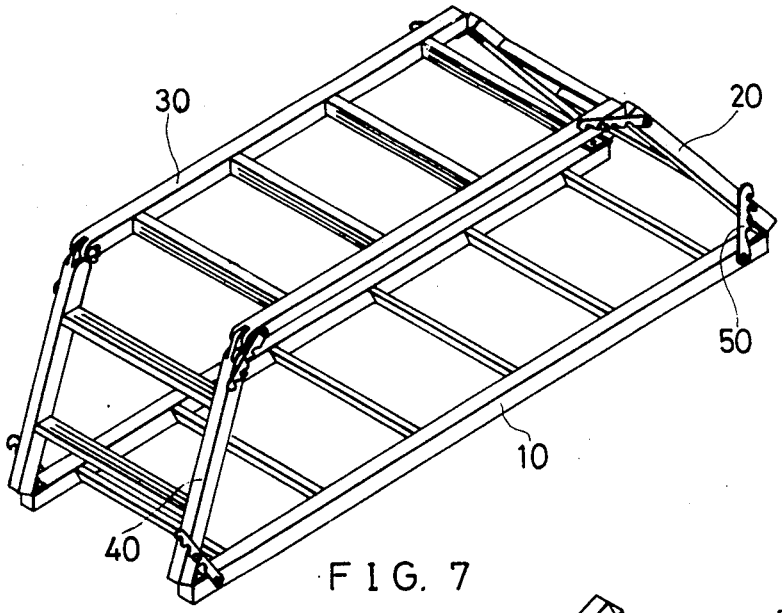
FIG. 7 is a perspective view of a multipurpose ladder in the form of a frame ladder in accordance with one preferred embodiment of the present invention.

Referring to FIG. 7, the multipurpose ladder is in the form of a frame ladder, in which, it takes the 1st section ladder (10) as a bottom and keeps the 3rd section-ladder in parallel to the 1st section-ladder by the 2nd and 4th section-ladders supporting at both sides respectively to form a trapezoid shape. So that, the user may climb up the ladder along the 2nd section-ladder (20) or the 4th section-ladder (40) to the 3rd section-ladder for work.

Figure 8:
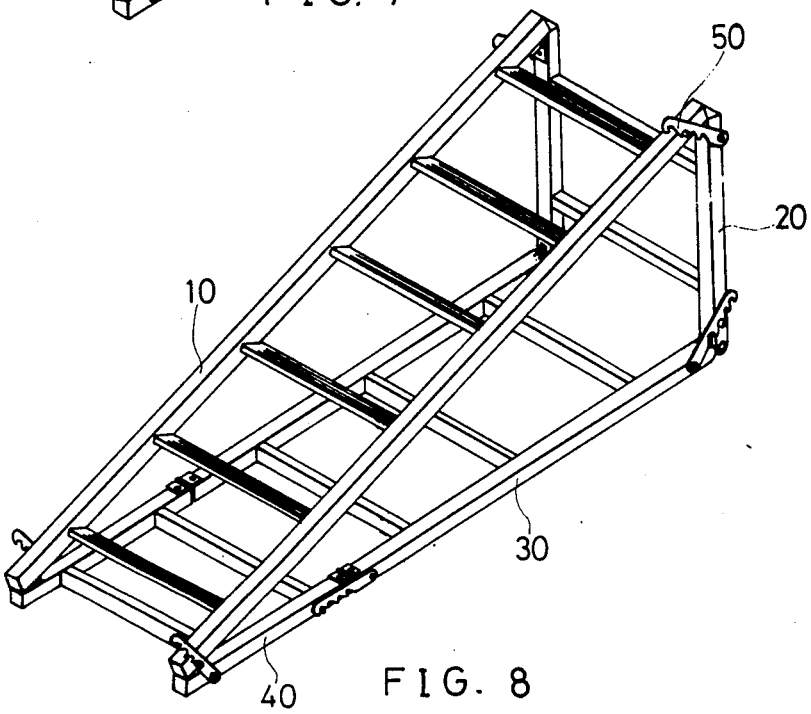
FIG. 8 is a perspective view of a multipurpose ladder in the form of a right-angled ladder in accordance with one preferred embodiment of the present invention.

As shown in FIG. 8, the multipurpose ladder is in the form of a right-angled ladder, in which, it employs the 3rd and 4th section-ladders (30) (40) as bottom and takes the 2nd section-ladder (20) perpendicular to the bottom while keeping the 1st section-ladder (10) oblique. Such structure not only matches Pythagoras theorem, but also has broader transverse step boards on the 1st section-ladder (10). So that, the user may climb up the ladder while holding things with his or her hands.

As explained above, it is a feature of the present invention that the multipurpose ladder may change to a climbing ladder, horse ladder, frame ladder and right-angled ladder according to practical need.

While the invention has been described in connection with what is presently considered to be the most practical and preferred embodiment, it is to be understood that the invention is not to be limited to the disclosed embodiment but on the contrary, is intended to cover various modifications and equivalent arrangements included within the spirit and scope of the appended claims which scope is to be accorded the broadest interpretation so as to emcompass all such modifications and equivalent structures.

What I claimed is:

1. A multipurpose ladder comprising four section-ladders with different lengths; a plurality of pivot joint devices provided between each section-ladder, respectively, for connection and at least one pivot joint device being separable; in which:

(a) disengaging one pivot joint device to make the four section-ladders to form a straight line to be a climbing ladder;

(b) applying the shortest section-ladder as a bottom and making the other three section-ladders forming an isosceles triangle to form a horse ladder;

(c) taking the longest section-ladder as bottom and keeping the longer section-ladder in parallel with the other two section-ladders supporting at both sides, respectively, to form a frame ladder in the shape of a trapezoid;

(d) employing the longer section-ladder and the shortest section-ladder as bottom, taking the shorter section-ladder perpendicular to the bottom while keeping the longest section-ladder oblique to form a right-angled ladder.

2. A multipurpose ladder as claimed in claim 1, wherein the length of the longest section-ladder is greater than the longer section-ladder is greater than the shorter section-ladder is greater than the shortest section-ladder.

3. A multipurpose ladder as claimed in claim 1, wherein the length of a longest section-ladder is equal to the length of a longer seciton-ladder plus the length of a shorter section-ladder so that it can form an isosceles triangle of a horse ladder.

* * * * *